United States Patent [19]

Byrd et al.

[11] 4,329,217

[45] May 11, 1982

[54] CLADDING CATHODE OF ELECTROLYTIC CELL WITH DIAPHRAGM OR MEMBRANE

[75] Inventors: Geoffrey C. M. Byrd, Frodsham; Colin Stanier, Northwich, both of England

[73] Assignee: Imperial Chemical Industries Limited, London, England

[21] Appl. No.: 166,744

[22] Filed: Jul. 7, 1980

[30] Foreign Application Priority Data

Jul. 20, 1979 [GB] United Kingdom ..... 7925382

[51] Int. Cl.[3] ..... C25B 9/00; C25B 13/02

[52] U.S. Cl. ..... 204/252; 204/253; 204/282; 204/283; 204/296

[58] Field of Search ..... 204/252, 253, 282, 283, 204/296

[56] References Cited

U.S. PATENT DOCUMENTS 3,878,082 4/1975 Gokhale ..... 204/226
4,156,639 5/1979 Vallance et al. ..... 204/252
4,191,637 3/1980 Specht ..... 204/296
4,268,372 5/1981 Iizima et al. ..... 204/252
4,278,523 7/1981 Byrd et al. ..... 204/252

FOREIGN PATENT DOCUMENTS 1516196 6/1978 United Kingdom .

*Primary Examiner*—F. Edmundson
*Attorney, Agent, or Firm*—Cushman, Darby & Cushman

[57] ABSTRACT

A diaphragm or membrane suitable for cladding a cathode box for use in an electrolytic cell and comprising a plurality of foraminate cathodes of the pocket type, the diaphragm or membrane comprising a sleeve portion and a plurality of tabs on both edges of the sleeve portion, and preferably two tabs on both edges of the sleeve portion, the dimensions of the sleeve portion being such that, when the diaphragm is positioned in a pocket of the cathode box, the edges of the sleeve portion and the tabs thereon project beyond the extremities of the pocket so that they may be joined to the tabs and sleeve portions of diaphragms or membranes in adjacent pockets of the cathode box.

14 Claims, 6 Drawing Figures

CLADDING CATHODE OF ELECTROLYTIC CELL WITH DIAPHRAGM OR MEMBRANE

Figure 1:
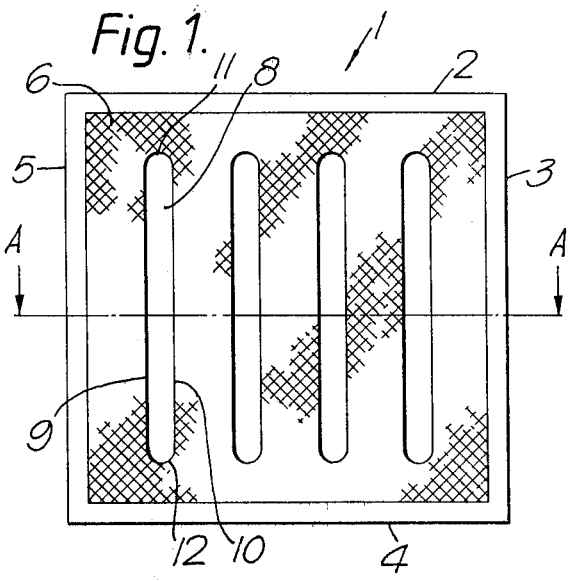

This invention relates to an electrolytic cell and in particular to the cladding of cathodes in such a cell with a diaphragm or membrane which separates the cell into anode and cathode compartments.

The electrolytic cell with which the invention is concerned is of the type which is generally used in the electrolysis of aqueous alkali metal chloride solution to produce chlorine and alkali metal hydroxide solution, especially the production of chlorine and sodium hydroxide solution by the electrolysis of aqueous sodium chloride solution. However, it is to be understood that the invention is not so limited and the electrolytic cell may be used for the electrolysis of solutions of ionisable compounds other than aqueous alkali metal chloride solutions.

Such electrolytic cells may comprise a cathode box having side walls and within the box a plurality of anodes evenly spaced from each other and generally parallel to each other and and fixed to a base, the anodes being positioned between adjacent cathode fingers or in the cathode pockets of the cathode box, and a diaphragm material on the cathode fingers or in the cathode pockets which divides the cell into separate anode and cathode compartments. The cathode fingers or pockets may have a foraminate structure, for example they may be formed of an expanded metal or may have a woven or net structure, and in a cell for the electrolysis of aqueous alkali metal chloride solution are generally formed of mild steel, although the cathodes may be formed of other materials, for example, nickel. Also the cathodes may be coated with a material which, for example, reduces the hydrogen overvoltage at the cathodes. The anodes may be formed of graphite but in modern practice are generally formed of a film-forming metal, that is a metal selected from the group titanium, zirconium, niobium, tatalum or tungsten or an alloy thereof, and may be coated with an electro-conducting electrocatalytically active material. The anodes may also have a foraminate structure. The cell is equipped with a header through which aqueous alkali metal chloride solution is fed to the anode compartment and with means through which chlorine is removed therefrom, and optionally with means through which depleted alkali metal chloride solution is removed therefrom. The cathode box is fitted with means for removing hydrogen and cell liquor containing alkali metal hydroxide therefrom, and optionally with means for feeding water thereto. The cathode box may be placed on the base to which the anodes are attached with the anodes being positioned between adjacent cathode fingers or in the cathode pockets, and the anolyte header tank may be placed on top of the cathode box.

The particular form of electrolytic cell with which the present invention is concerned is one in which the cathode box comprises a plurality of cathodes of the pocket type.

For many years the foraminate structures in cathode boxes of electrolytic cells have been clad with asbestos diaphragms by immersing the cathode box in a suspension of asbestos fibres in, for example, cell liquor, and drawing the asbestos fibres by suction onto the foraminate structure. A mat of asbestos fibres is thereby formed on the foraminate structure of the cathode box. Although such asbestos diaphragms have been used for many years, and of course continue to be used on a large scale, there is a need to replace asbestos diaphragms by other materials which do not swell during use in electrolysis. Thus, where aqueous alkali metal chloride solution is electrolysed in a cell equipped with an asbestos diaphragm the anode-cathode gap must be greater than is desirable, with consequent increase in voltage, at least in part to provide for the swelling of the asbestos diaphragm which takes place during electrolysis. There is also a need to replace abestos by materials which do not have the toxic properties of asbestos and which have a longer effective lifetime than asbestos, especially when used in an electrolytic cell for the electrolysis of aqueous akali metal chloride solution.

Many different types of diaphragms made of synthetic polymeric materials have been developed. For example, in British Pat. No. 1,081,046 in the name of Imperial Chemical Industries Limited there is described a sheet diaphragm of porous polytetrafluoroethylene which is produced by forming a sheet of polytetrafluoroethylene and a particulate filler, e.g starch, and extracting the filler from the sheet. In British Pat. No. 1,503,915, also in the name of Imperial Chemical Industries Limited, there is described an electrochemical cell, particularly suitable for use in the production of chlorine and alkali metal hydroxide by the electrolysis of aqueous alkali metal chloride solution, the cell comprising an anode and a cathode separated by a porous polytetrafluorethylene diaphragm which has a microstructure of nodes interconnected by fibrils. The porous polytetrafluoroethylene, diaphragm, and a method of producing the diaphragm, is itself described in British Pat. No. 1,355,373 in the name of W. L. Gore and Associates Inc.

Many of the synthetic diaphragms which have been developed suffer from the disadvantage that they cannot be applied to the foraminate cathodes of electrolytic cells by the techniques which have hitherto been used to apply asbestos diaphragms to such foraminate structures. In particular synthetic diaphragms in the form of a sheet are difficult to apply to cathode boxes in which the foraminate cathodes are in the form of a plurality of fingers or pockets. It is difficult to ensure that the diaphragm conforms to the somewhat irregular shape of such cathode boxes and it is also difficult to ensure that the diaphragm is adequately sealed so that it is free of leaks. Special techniques have had to be developed to clad such cathodes boxes with synthetic diaphragms.

In Belgian Pat. No. 864 400 in the name of the Olin Corporation there is described a sheath for cladding an essentially rectangular electrode, the sheath having a closed end, an open end, and two closed sides, at least one of the closed sides consisting of a main section and a section in the form of a lug, the lug being adjacent to the open end. In use the sheath is placed over the cathode and the lug, which is flexible, is bent or twisted to form an essentially flat surface, and methods of clamping or gripping are applied for the effective sealing of the sheaths along their upper and lower edges. The sheaths described are suitable for use in the cladding of a cathode box containing a plurality of cathodes of the finger type.

A number of prior disclosures of methods of cladding cathode boxes with synthetic diaphragm materials necessitate the use of special clamping devices. For example, in U.S. Pat. No. 3,980,544, also in the name of the Olin Corporation, there is described a diaphragm in the form of an envelope which is suitable for cladding foraminate electrodes, especially cathodes, which are positioned parallel to each other and which have a space between each electrode, the diaphragm envelope having an open end and having two adjoining edges which are clamped between a clamping element and a bar positioned between the electrodes. This diaphragm structure and clamping method is particularly suitable for cladding of finger type electrodes.

In U.S. Pat. No. 3,878,082 in the name of BASF Wyandotte Corporation there is described a means for cladding cathodes of both the finger type and the pocket type. In a cathode box comprising cathodes of the finger type a diaphragm in the form of an envelope is positioned over the cathode finger and a U-shaped retainer is positioned over the diaphragm at the junction between adjacent cathode fingers. In a cathode box of the pocket type the diaphragm is wrapped over the cathode and retained in the pocket by means of crescent shaped retainers positioned over the diaphragm in the pocket. U-shaped retainers are also placed over the diaphragm, the U-shaped retainers also cooperating with the crescent shaped retainers.

In U.S. Pat. No. 3,923,630, also in the name of BASF Wyandotte Corporation, there is described a method of cladding a cathode box of the pocket type with synthetic diaphragm material. In the method slotted support members are positioned above and below the cathode box with the slots in the supports being aligned with the pockets in the cathode box, and each pocket is clad with a diaphragm in the form of an endless belt, the diaphragms being sealed to the slots in the upper and lower support members. The sealing may be effected for example, by heat sealing, as described in Belgian Pat. No. 865864, or by mechanical means, as described in published European Patent Application No. 0008165, both in the name of Imperial Chemical Industries Limited.

The present invention provides a means for cladding a cathode box comprising a plurality of foraminate cathodes of the pocket type which is particularly effective and which does not necessarily rely for its effectiveness on the provision of shaped clamping means to position the diaphragm in the cathode box. Furthermore, the cladding means does not rely for its effectiveness on the provision of slotted support members of the type hitherto described.

The present invention is applicable not only to the cladding of a cathode box with a diaphragm which is hydraulically permeable and which permits electrolyte to flow through the diaphragm between the anode and cathode compartments of the electrolytic cell but also to the cladding of a cathode box with substantially hydraulically impermeable materials, commonly referred to as membranes, which permit transfer of ionic species between the anode and cathode compartments of an electrolytic cell. Such membranes are generally cation selective and are becoming of increasing commercial importance, particularly where it is desired to produce a cell liquor substantially free of contaminants, for example an aqueous alkali metal hydroxide solution substantially free of alkali metal chloride.

Unless otherwise stated, we will for simplicity refer hereafter to "diaphragms" but it is to be understood that the term "diaphragms" as used includes both hydraulically permeable materials and substantially hydraulically impermeable ion-selective materials as described.

According to the present invention there is provided a diaphragm suitable for cladding a cathode box comprising a plurality of foraminate cathodes of the pocket type, the diaphragm comprising a sleeve portion and a plurality of tabs on both edges of the sleeve portion, the dimensions of the sleeve portion being such that, when the diaphragm is positioned in a pocket of a cathode box, the edges of the sleeve portion and the tabs thereon project beyond the extremities of the pocket.

In a preferred embodiment of the invention the diaphragm comprises a sleeve portion, two tabs on one edge of the sleeve portion and two tabs on the other edge of the sleeve portion, the tabs on one edge being aligned with the tabs on the other edge to form pairs of aligned tabs each pair comprising a tab on one edge of the sleeve portion and a tab on the other edge of the sleeve portion, the pairs of tabs being positioned substantially opposite to each other on the sleeve portion.

The diaphragm of the present invention is suitable for use in the cladding of a cathode box comprising a plurality of foraminate cathodes of the pocket type. The phrase "a cathode box comprising a plurality of foraminate cathodes of the pocket type" as used in the present specification and claims means a cathode box having walls, a top and a bottom which generally have a foraminate structure, and a plurality of pockets substantially parallel to each other and formed by foraminate walls positioned between the top and bottom, the pockets forming cavities in which the anodes of an electrolytic cell may be positioned; the pockets, in plan view, are generally elongated in shape having two substantially parallel and relatively long side walls and two relatively short end walls joining the side walls.

In order to clad a cathode box of the aforementioned type a diaphragm of the invention is positioned in each cathode pocket of the cathode box with the edges of the sleeve portion and the tabs thereon projecting beyond the extremities of the pocket, that is projecting above and below the top and bottom edges of the walls of the pocket, and the projecting parts of the sleeve portion and the tabs thereon are folded towards the upper and lower (foraminate) surfaces of the cathode box to a position which is adjacent to the tabs and projecting sleeve portions of a diaphragm which is in a next adjacent pocket and which have similarly been folded, and the tabs and projecting sleeve portions of diaphragms in adjacent pockets are joined together.

When the preferred embodiment of the diaphragm of the invention is used a diaphragm is positioned in each cathode pocket of the cathode box with the edges of the sleeve portion and the tabs thereon projecting above and below the extremities of the pockets, and the tabs on the sleeve portions are positioned adjacent to the end walls of the pockets.

The tabs and projecting sleeve portions of a diaphragm, which in use are folded over to position adjacent to the tabs and projecting sleeve portions of a diaphragm in a next adjacent pocket, are joined to the tabs and sleeve portion of the diaphragm in the next adjacent pocket. The joining may be by means of a clamp, e.g a U-shaped clamp which may be fastened onto the adjacent tabs and sleeve portions, e.g by crimping. Alternatively the joining may be effected by means of a suitable adhesive. In a preferred method, however, the tabs and projecting sleeve portion of a diaphragm in one pocket are positioned so as to overlap, or make face to face contact with, the tabs and projecting sleeve portion of a diaphragm in a next adjacent pocket and the tabs and sleeve portions of the diaphragms in adjacent pockets are sealed to each other by use of a welding technique which results in fusion of the diaphragm together, for example by use of heat sealing. The use of a welding technique, for example heat sealing, or the use of an adhesive, eliminates the need to use clamps or any other such mechanical sealing means.

It is preferred that the tabs and projecting sleeve portions of diaphragms in adjacent pockets of the cathode box make face-to-face contact with each other as this facilitates the joining. It particularly facilitates joining by heat sealing as heat may be applied to the tabs and projecting sleeve portions of both diaphragms.

It is also preferred that the dimensions of the tabs on the sleeve portion of the diaphragm are so chosen that when the tabs and projecting sleeve portions of the diaphragms are folded over the edges of the tabs and sleeve portions form a straight line as this also facilitates the joining of the tabs and projecting sleeve portions of diaphragms in adjacent pockets of the cathode box.

A part of the tabs, e.g the ends of the tabs, will clearly not be sealed to the tabs of an adjacent diaphragm. The ends of the tabs may extend at least to the edge of the wall of the cathode box, and preferably somewhat beyond the edge of the wall of the cathode box, where they may be sealed thereto, at the top, by clamping between the wall of the box and for example an anolyte header tank, and at the bottom by clamping between the wall of the box and for example the base of the electrolytic cell. Similarly, the projecting sleeve portion and tabs of the diaphragms in the end pockets of the cathode box adjacent to the wall of the cathode box may be folded over and sealed to the cathode box, at the top by clamping between the wall of the box and for example an anolyte header tank, and at the bottom by clamping between the wall of the box and for example the base of the electrolytic cell. Thus, the entire foraminate surface of the cathode box, including the top and bottom of the box in addition to the walls of the pockets, may be clad with the diaphragm material.

The diaphragm of the invention may be made from a sheet of substantially rectangular shape having a plurality of tabs on one edge of the sheet and a plurality of tabs on the opposite edge of the sheet, and the edges of the rectangular sheet which do not have tabs thereon may be joined to each other to form a sleeve-like structure. The preferred diaphragm of the invention may be made from a sheet of substantially rectangular shape having two tabs on one edge of the sheet and two tabs on the opposite edge of the sheet, the tabs on one edge being aligned with the tabs on the opposite edge to form pairs of aligned tabs, each pair comprising a tab on one edge and a tab on the opposite edge, the pairs of tabs being so positioned that, when the opposite edges of the sheet which do not have tabs are joined to form a sleeve-like structure, the pairs of tabs are positioned substantially opposite to each other in the sleeve-like structure.

Any suitable method of joining the edges of the sheet of substantially rectangular shape may be used, dependent to some extent on the nature of the diaphragm material. The edges may be over-lapped and joined by welding, for example by heat sealing the diaphragm material to itself, or the diaphragm material may be joined to itself by use of an adhesive. Alternatively, the edges may be sealed to a strip of a different material.

The dimensions of the sheet of substantially rectangular shape, and thus of the sleeve-like structure which may be formed therefrom, should be sufficiently great that a part of the sleeve-like structure projects beyond the extremities of the pockets of the cathode box, that is above and below the top and bottom edges of the walls of the pockets of the cathode box. The precise shape of the rectangular shaped sheet will depend on the dimensions of the pockets in the cathode box. The rectangular shape may, for example, be square-or oblong-shaped. The tabs on the rectangular shaped sheet and on the sleeve-like structure may also be substantially rectangular in shape.

Where the diaphragm of the present invention is hydraulically permeable it may be made of a porous organic polymeric material. Preferred organic polymeric materials are fluorine-containing polymers on account of the generally stable nature of such materials in the corrosive environment encountered in many electrolytic cells. Suitable fluorine-containing polymeric materials include, for example, polychloro-trifluoroethylene, fluorinated ethylene-propylene copolymer, and polyhexafluoropropylene. A preferred fluorine-containing polymeric material is polytetrafluoroethylene on account of its great stability in corrosive electrolytic cell environments, particularly in electrolytic cells for the production of chlorine and alkali metal hydroxide by the electrolysis of aqueous alkali metal chloride solutions. Such hydraulically permeable diaphragm materials are known in the art.

Preferred diaphragm materials which are capable of transferring ionic species between the anode and cathode compartments of an electrolytic cell, commonly referred to as membranes, are those which are cation selective. Such ion exchange materials are known in the art and are preferably fluorine-containing polymeric materials containing anionic groups. The polymeric materials preferably are fluorocarbons containing the repeating groups.

$$\left[C_mF_{2m}\right]_M \text{ and } \left[CF_2-\underset{\underset{X}{|}}{CF}\right]_N$$

where m has a value of 2 to 10, and is preferably 2, the ratio of M to N is preferably such as to give an equivalent weight of the groups X in the range 600 to 2000, and X is chosen from $$A \text{ or } \left[OCF_2-\underset{\underset{Z}{|}}{CF}\right]_p A$$

where p has a value of for example 1 to 3, Z is fluorine or a perfluoroalkyl group having from 1 to 10 carbon atoms, and A is a group chosen from the groups:

$-SO_3H$
$-CF_2SO_3H$
$-CCl_2SO_3H$
$-X^1SO_3H$
$-PO_3H_2$
$-PO_2H_2$
$-COOH$ and
$-X^1OH$ or derivatives of the said groups, where $X^1$ is an aryl group. Preferably A represents the group $SO_3H$ or —COOH. $SO_3H$ group-containing ion exchange membranes are sold under the trade name 'Nafion' by E. I. du Pont de Nemours and Co. Inc. and —COOH group-containing ion exchange membranes under the trade name 'Flemion' by the Asahi Glass Co. Ltd.

The diaphragm of the invention may be made of a single diaphragm material, or it may be made of a plurality of materials, for example of a plurality of diaphragm materials. For example, the rectangular-shaped sheet, or the sleeve portion of the diaphragm, may be made of a diaphragm material, and the tabs thereon may be made of a different material, which may or may not be a diaphragm material, particularly of a material which is pliable and which is readily welded, for example heat sealed. Alternatively, part of the rectangular-shaped sheet, or a part of the sleeve portion of the diaphragm, may be made of a diaphragm material, and the tabs and those parts of the rectangular-shaped sheet and of the sleeve portion adjacent to the tabs, which in use project beyond the extremities of the pockets of the cathode box and which are folded over when the diaphragm is positioned in a pocket of the cathode box, may be made of a different material, which may or may not be a diaphragm material, particularly a material which is pliable and which is readily welded, for example heat-sealed. The tabs, and if desired those parts of the sleeve portion which project beyond the extremities of the cathode box and which are folded over when the diaphragm is positioned in a pocket of the cathode box, may even be made of a non-diaphragm material, that is of a material which is neither hydraulically permeable nor which permits transfer of ionic species between the anode and cathode compartments of the electrolytic cell.

The cathode box clad with a diaphragm of the invention may form part of an electroylic cell. The cathode box may be equipped with a port or ports for removing cell liquor and gaseous products therefrom, and with a port through which liquid, e.g water, may be charged to the cathode box. The foraminate surfaces of the cathode box may be of expanded metal or of a woven or net structure. The cathode box, and particularly the foraminate surfaces thereof, are preferably made of steel, e.g mild steel, especially in the case where the electrolytic cell is to be used in the electrolysis of an aqueous alkali metal chloride solution.

The anodes in the cell may suitably be mounted on a base and be so positioned that, when the cathode box is positioned thereon, the anodes are located in the pockets of the cathode box. The anodes, and the base, may be made of a film-forming metal or alloy thereof, that is titanium, niobium, zirconium, tantalum or tungsten or alloy thereof, and the anodes may carry a surface coating of an electroconducting electrocatalytically active material, for example, a coating comrising a platinum group metal and/or a platinum group metal oxide. A preferred coating is a mixed oxide coating of a platinum group metal oxide and a film-forming metal oxide, e.g. $RuO_2$ and $TiO_2$. In the electrolytic cell an anolyte header tank may be positioned on top of the cathode box, the header tank being equipped with a port through which electrolyte may be fed to the anode compartments of the cell and ports through which gaseous products of electrolysis and depleted electrolyte may be removed from the cell.

The invention is now illustrated by the following drawings in which

Figure 2:
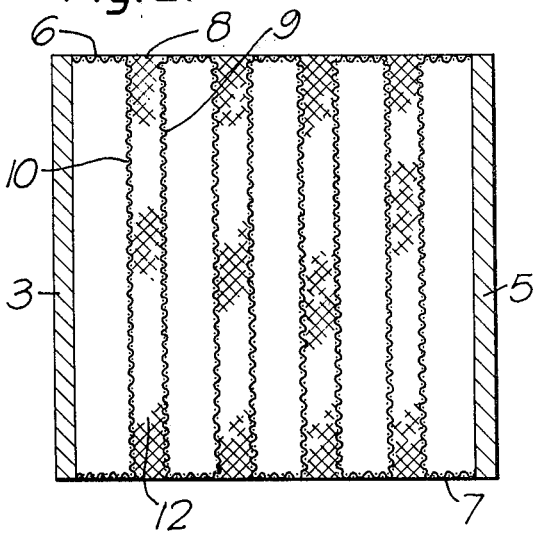
Figure 3:
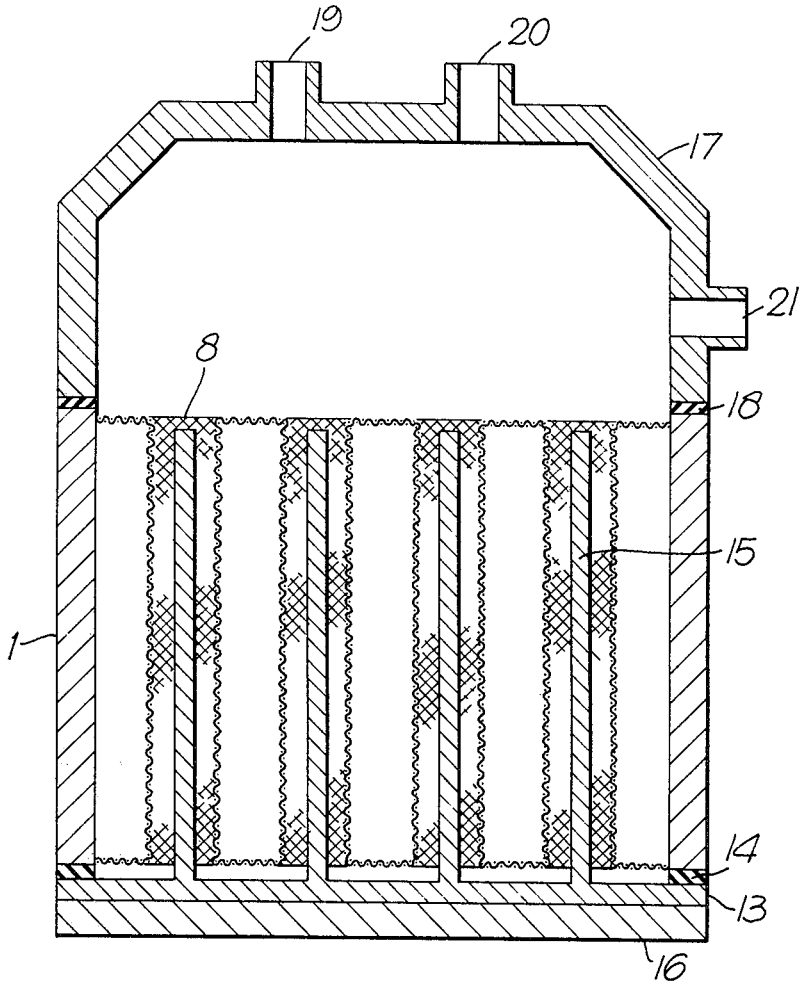
Figure 4:
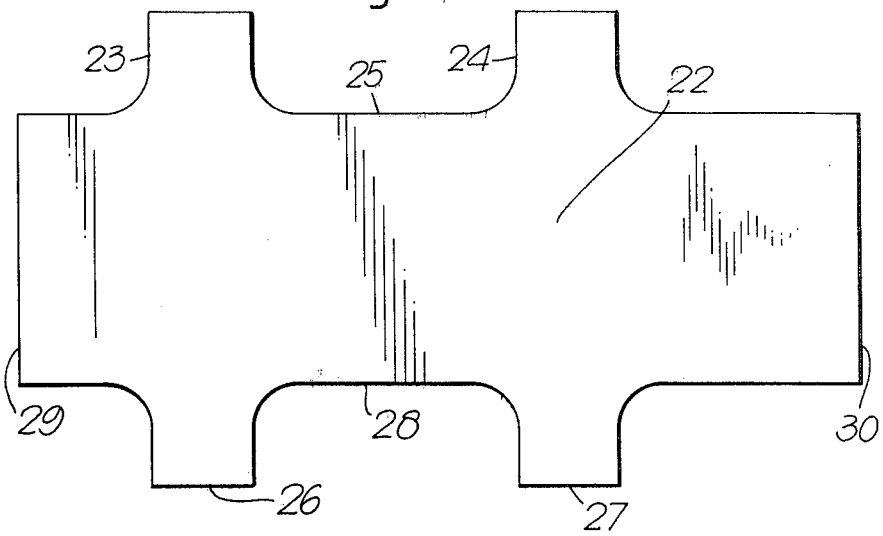
Figure 5:
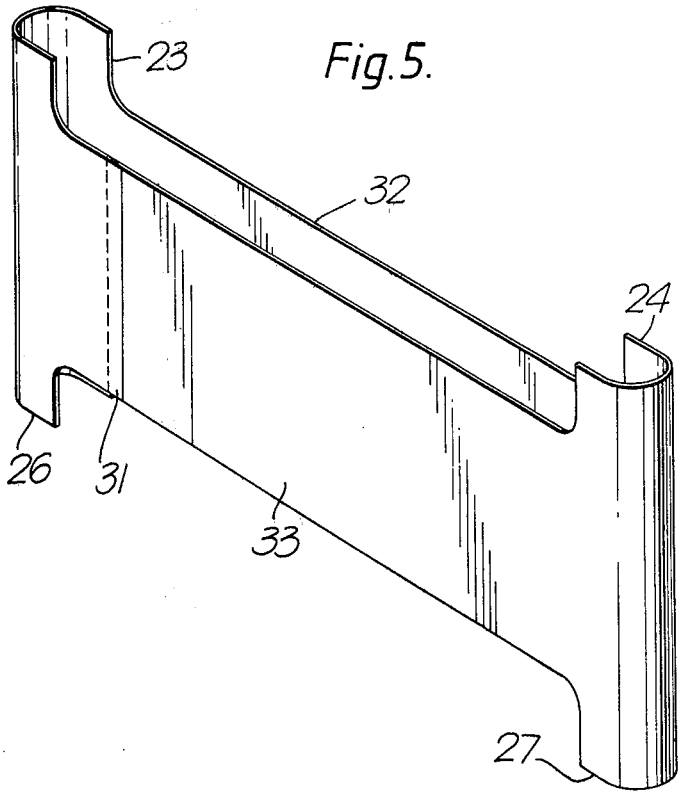
Figure 6:
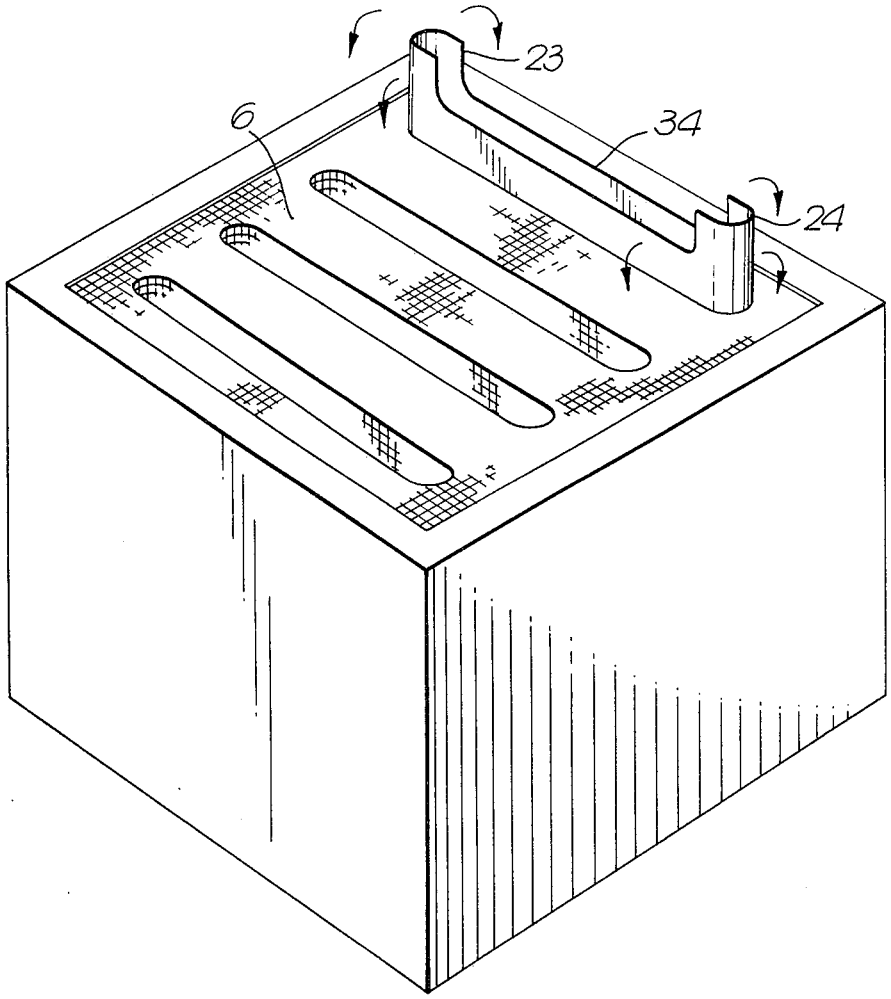
Figure 7:
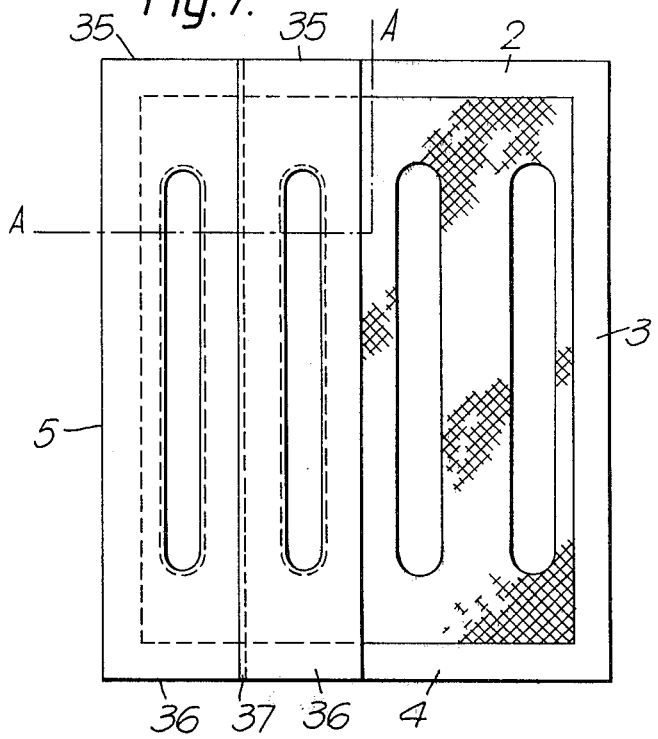
Figure 8:
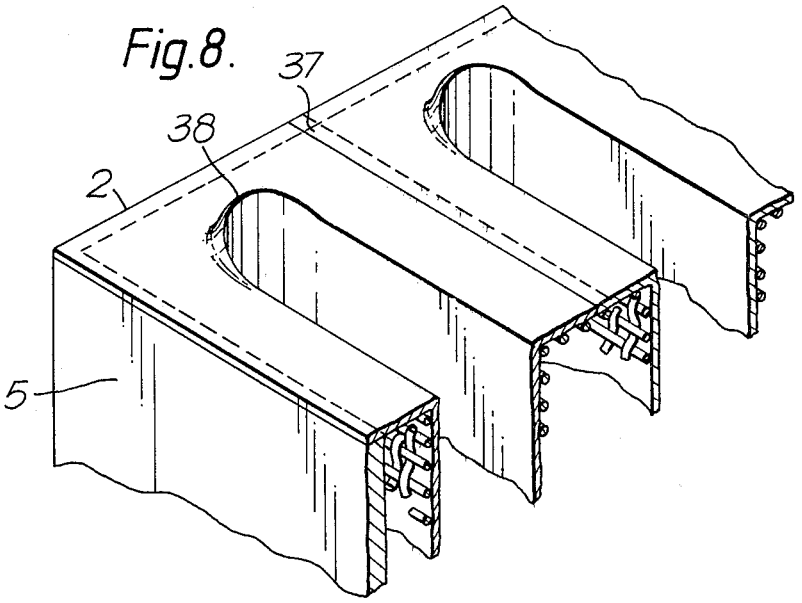

FIG. 1 shows a plan view of a cathode box which is to be clad with a diaphragm of the invention, FIG. 2 shows a cross-sectional view in elevation of the cathode box along the line A—A of FIG. 1, FIG. 3 shows a cross-sectional view in elevation of an electrolytic cell, for the sake of convenience the diaphragm having been omitted from the cell which is shown, FIG. 4 shows a plan view of a sheet from which a diaphragm of the invention may be assembled, FIG. 5 shows an isometric view of a diaphragm of the invention, FIG. 6 shows an isometric view of a cathode box with a diaphragm positioned in one of the pockets of the box, FIG. 7 shows a plan view of a cathode box with two of the pockets of the cathode box clad with a diaphragm of the invention, and FIG. 8 shows an isometric view of that part of the cathode box bounded by the lines A—A of FIG. 7.

Referring to FIGS. 1 to 3 the cathode box (1) comprises side walls (2,3,4,5), which may be equipped with ports (not shown) through which water or other liquid may be fed to the cathode box and through which liquid and gaseous products of electrolysis may be removed from the cathode box, a foraminate top (6), and a foraminate base (7). The foraminate structure may be an expanded metal but in the embodiment illustrated it is a woven wire mesh, suitably of mild steel where the cell is to be used for the electrolysis of an aqueous alkali metal chloride solution. The cathode box comprises four pockets (8) which are parallel to each other and which are elongated in shape and which are formed by side walls (9,10) and end walls (11,12) between the foraminate top (6) and foraminate base (7) of the cathode box. For the sake of convenience in the embodiment illustrated the cathode box has been shown as comprising four pockets only. It is to be understood that the cathode box may comprise a much larger number of pockets, for example forty or more such pockets. The cathode box is also equipped with an electrical connection which for the sake of convenience is not shown.

The electrolytic cell shown in FIG. 3 comprises a cathode box (1) which is positioned on a base plate (13) and insulated therefrom by a gasket (14) of an electrically insulating material which is resistant to corrosion by the liquors in the cell. A plurality of anodes (15) are mounted on the baseplate (14). The anodes are parallel to each other and positioned in the pockets (8) of the cathode box. A base (16) through which electrical power may be fed to the anodes of the cell is in electrical contact with the baseplate (14). The connection of the power source is conventional and for the sake of convenience is not shown.

Where the electrolytic cell is to be used in the electrolysis of aqueous alkali metal chloride solution the anodes (15) and the baseplate (14) may suitably be made of a film-forming metal, for example titanium, and the anode surfaces may suitably be coated with a layer of an electroconducting electrocatalytically active material of the type hereinbefore described.

An anolyte header tank (17) is positioned on the cathode box (1) and insulated therefrom by means of a gasket (18) of an electrically insulating material which is resistant to corrosion by the liquors in the cell. The anolyte header tank (17) is equipped with three ports (19,20,21) through which, respectively, electrolyte solution may be fed to the cell and gaseous products of electrolysis and depleted electrolyte solution may be removed from the cell.

Referring to FIG. 4 the diaphragm may be made from a rectangular sheet (22) of a suitable material, for example one of those hereinbefore referred to, which has two tabs (23,24) on one edge (25) and two tabs (26,27) on the opposite edge (28), the tabs (23,26 and 24,27) on the opposite edges of the sheet being aligned in pairs. The other edges (29,30) of the rectangular sheet do not have tabs. These latter edges may be brought together and sealed to each other, for example by overlapping and heat sealing as indicated by the seal (31) in FIG. 5, to form a diaphragm (32) having a sleeve portion (33) and two tabs (23,24) on one edge of the sleeve portion and two tabs (26,27) on the other edge of the sleeve portion, the tabs on the opposite edges (23,26 and 24,27) being aligned in pairs and the pairs of tabs being positioned opposite each other on the sleeve portion.

Referring now to FIG. 6 the diaphragm illustrated in FIG. 5 is positioned in one of the pockets of the cathode box with the tabs (23,24) and the upper part (34) of the sleeve portion (33) projecting above the level of the foraminate top (6) of the cathode box. Similarly, although not shown in FIG. 6, the tabs (26,27) and the lower part of the sleeve portion (33) project below the level of the foraminate base (7) of the cathode box. In order to cover the foraminate top (6) of the cathode box the tabs (23,24) and the upper part (34) of the sleeve portion (33) of the diaphragm are folded towards and contacted with the foraminate top (6) in the direction indicated by the arrows in FIG. 6, the edges of the tabs (23, 24) and the edge of the upper part (34) of the sleeve portion (33) falling substantially into a straight line to facilitate joining to the tabs and sleeve portion of a diaphragm in an adjacent pocket of the cathode box. Similarly, the tabs (26,27) and the lower part of the sleeve portion (33) are folded towards and contacted with the foraminate base (7) of the cathode box.

Referring to FIGS. 7 and 8 the diaphragms in adjacent pockets of the cathode box have dimensions such that ends (35,36) of the tabs (23,24) project onto the walls (2,4) of the cathode box and the edges of the tabs (23,24) and the upper part (34) of the sleeve portion (33) of the diaphragm in the pocket next to the end wall (5) project over this end wall. The tabs and sleeve portion in adjacent pockets which are folded towards each other overlap as indicated at (37) and may be sealed to each other by the methods hereinbefore described, for example, by heat sealing. The folding over of the tabs may necessitate the formation of a tuck (38) in the diaphragm.

In order to assemble the electrolytic cell the cathode box (1) clad with diaphragm (32) is placed on the baseplate (14) and the anolyte header tank (17) is placed on the cathode box in the manner hereinbefore indicated, and the cell is bolted together.

The electrolytic cell is operated by feeding aqueous alkali metal chloride solution to the anolyte header (17) through port (19) and gaseous chlorine produced in electrolysis is removed through port (20). Depleted alkali metal chloride solution may if necessary be removed through port (21). Where the diaphragm is hydraulically permeable the solution of alkali metal chloride passes through the diaphragm and hydrogen and a solution of alkali metal hydroxide containing alkali metal chloride is removed from the cathode box through ports which are not shown. Where the diaphragm is a hydraulically impermeable ion exchange membrane the cathode box may be equipped with a port through which water or dilute alkali metal hydroxide solution may be fed to the cathode box, and hydrogen and aqueous alkali metal hydroxide solution are removed from the cathode box through ports which are not shown.

We claim:

1. A diaphragm, suitable for cladding a cathode box comprising a plurality of foraminate cathodes of the pocket type, the diaphragm comprising:

a sleeve portion having a pair of open ends defined by edges;

a plurality of tabs on both edges of the sleeve portion;

the sleeve portion having an exterior circumference substantially the same as interior circumference of a pocket of the cathode box;

the material comprising the edges and tabs of said diaphragm being flexible; and the sleeve portion having a length such that when the diaphragm is positioned in a pocket of the cathode box, the edges of the sleeve portion and the tabs thereon project beyond the extremities of the pocket and the tabs may fold towards the upper and lower surfaces of the cathode box to a position in which they are adjacent and joinable to the projecting part and tabs of a sleeve diaphragm in an adjacent pocket which have been similarly folded.

2. A diaphragm as claimed in claim 1 which comprises a sleeve portion, two tabs on one edge of the sleeve portion and two tabs on the other edge of the sleeve portion, the tabs on one edge being aligned with the tabs on the other edge to form pairs of aligned tabs each pair comprising a tab on one edge of the sleeve portion and a tab on the other edge of the sleeve portion, the pairs of tabs being positioned substantially opposite to each other on the sleeve portion.

3. A diaphragm as claimed in claim 1 which is made of a single diaphragm material.

4. A diaphragm as claimed in claim 1 which is made of a plurality of materials.

5. A diaphragm as claimed in claim 4 in which the sleeve portion is made of a diaphragm material and in which the tabs are made of a different material.

6. A diaphragm as claimed in claim 4 in which a part of the sleeve portion is made of a diaphragm material and in which the tabs and those parts of the sleeve portion adjacent to the tabs and which in use project beyond the extremities of the pockets of the cathode box are made of a different material.

7. A diaphragm as claimed in claim 6 in which the said different material is a diaphragm material.

8. A diaphragm as claimed in claim 1 in combination with the cathode box, disposed in a pocket of the cathode box, and in combination with a plurality of like diaphragms disposed in other pockets of the cathode box; and further comprising means for joining together folded over tabs and projecting sleeve portions of diaphragms in adjacent pockets to provide effective cladding, said means consisting of heat sealing.

9. A method of cladding a cathode box comprising a plurality of foraminate cathodes of the pocket type, utilizing a diaphragm comprising a sleeve portion having a pair of open ends defined by edges, and a plurality of tabs on both edges of the sleeve portion, the diaphragm having an exterior circumference substantially the same as the interior circumference of a pocket of the cathode box, and having a length such that when the diaphragm is positioned in a pocket of the cathode box both edges of the sleeve portion and the tabs thereon project beyond the extremities of the pocket, the method consisting essentially of the steps of:

positioning a diaphragm in each pocket of the cathode box with both edges of the sleeve portion and the tabs thereon projecting beyond the extremities of the pockets;

folding the projecting parts of the sleeve portions and the tabs thereon towards the upper and lower surfaces of the cathode box to a position which is adjacent to the tabs and projecting sleeve portions of a diaphragm in a next adjacent pocket and which have been similarly folded; and joining together the tabs and projecting sleeve portions of the diaphragms of adjacent pockets to provide effective cladding.

10. A method as claimed in claim 9 in which the pockets of the cathode box have two substantially parallel and relatively long side walls and two relatively short end walls joining the side walls, and in which the tabs on the sleeve portions of the diaphragms are positioned adjacent to the end walls.

11. A method as claimed in claim 9 in which the tabs and projecting sleeve portions of a diaphragm, when folded towards the upper and lower surfaces of the cathode box, overlap the tabs and projecting sleeve portions of a diaphragm in an adjacent pocket of the cathode box which have similarly been folded towards the upper and lower surfaces of the cathode box.

12. A method is claimed in claim 9 in which the tabs and projecting sleeve portions of a diaphragm, when folded towards the upper and lower surfaces of the cathode box, make face-to-face contact with the tabs and projecting sleeve portions of a diaphragm in an adjacent pocket of a cathode box which have similarly been folded towards the upper and lower surfaces of the cathode box.

13. A method as claimed in claim 9 in which the tabs and projecting sleeve portions of diaphragms in adjacent pockets are joined together by heat sealing.

14. A method as claimed in claim 9 wherein said joining step is practiced by a procedure consisting of heat sealing.

* * * * *